United States Patent [19]

Smith et al.

[11] Patent Number: 4,744,186

[45] Date of Patent: May 17, 1988

[54] FIREPROOF BUILDING PANELS

[76] Inventors: Terry M. Smith, 102 Walker Rd., Washington Crossing, Pa. 18977; Hugh W. Smith, 1007 Castle Ridge Rd., Austin, Tex. 78746

[21] Appl. No.: 21,400

[22] Filed: Mar. 4, 1987

[51] Int. Cl.[4] ..... E04B 1/74

[52] U.S. Cl. ..... 52/404; 52/506

[58] Field of Search ..... 52/404, 506, 474

[56] References Cited

U.S. PATENT DOCUMENTS

| | | | |
|---|---|---|---|
| 3,736,715 | 6/1973 | Krumwiede | 52/404 X |
| 3,872,636 | 3/1975 | Nicosia | 52/404 X |
| 4,257,204 | 3/1981 | Rieger | 52/404 X |
| 4,501,101 | 2/1985 | Davis | 52/404 |
| 4,516,374 | 5/1985 | Finney | 52/404 |
| 4,557,092 | 12/1985 | Brueske | 52/404 |
| 4,569,174 | 2/1986 | Bossany | 52/404 X |

*Primary Examiner*—J. Karl Bell

*Attorney, Agent, or Firm*—Arnold, White & Durkee

[57] ABSTRACT

The invention disclosed herein relates to fireproof building panels for use in building structures and in adding to existing structures where it is desired to insulate the internal volume defined by the structure from a high outside ambient temperature. The building panel is comprised of a fiber insulating material placed against a metal screen. The outer perimeter of the fiber material and the metal frame is surrounded by a metallic channel.

14 Claims, 3 Drawing Sheets

Fig. 2
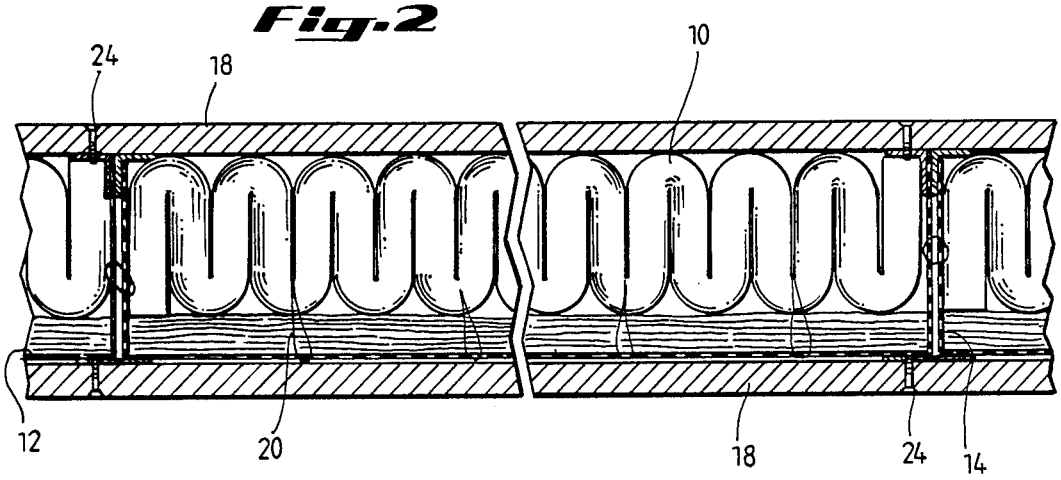
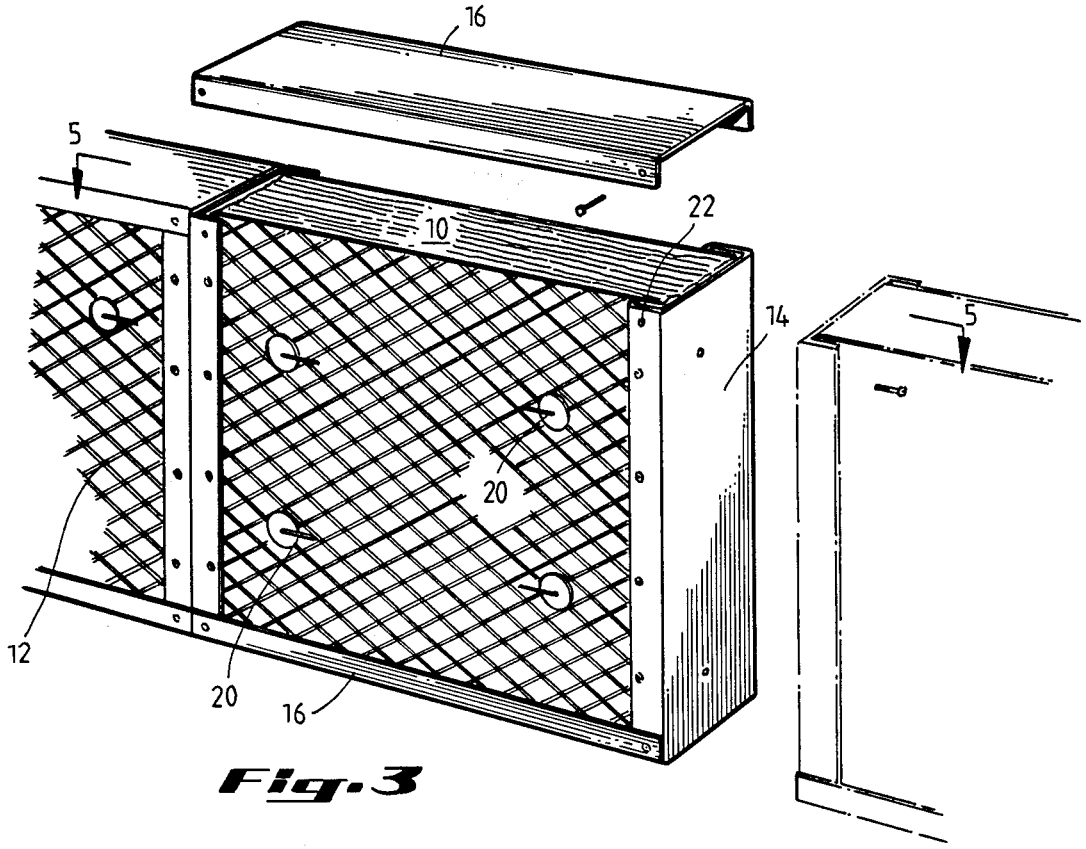
Fig. 3

FIREPROOF BUILDING PANELS

BACKGROUND OF THE INVENTION

1. Field of the Invention

The invention disclosed herein relates to fireproof building panels for use in building structures where it is desired to insulate the internal volume defined by the structure from a high outside ambient temperature. The building panel is comprised of a fiber insulating material placed against an expanded metal frame. The outer perimeter of the fiber material and the metal frame is surrounded by a metallic channel.

The invention is particularly well suited for constructing areas to store materials which deteriorate or become inoperable at ambient temperatures in excess of 150° F.

2. Description of the Prior Art

The harmful effects of fire and extreme heat have long presented a concern to those persons involved in the art of storage. One of the most common methods of addressing this concern is the use of sprinkler systems or other fire suppression systems, such as those using inert gases. In many cases, due to the nature of the items stored, such conventional systems may not be practicable.

In the area of records storage, the records and other data medium stored can be destroyed by the heat resulting from a fire or conflagration in an area or room adjoining the record storage area. Magnetic tapes, such as those used in conjunction with computer data bases, and photographic film deteriorate at temperatures in excess of 150° F. Present day records storage vaults are incapable of maintaining an internal temperature below 300° F. when the ambient temperature conditions outside the vault exceed 1500° F., as in the case of a building fire.

Walls or panels of present day records storage vaults comprise a steel body covered with plasterboard or plasterboard and fiberglass insulation. After prolonged exposure to temperatures in excess of 1500° F., the plasterboard of the present day records storage vaults will burn and the fiberglass will eventually melt, leaving the metallic walls of the vault directly exposed to the high ambient temperatures produced by the fire. Under these conditions, magnetic tapes, photographic film, and paper products stored within the records vault will be destroyed.

SUMMARY OF THE INVENTION

The present invention provides a means to insulate the records and other sensitive materials kept in records storage vaults from the high temperatures produced by fires occurring outside the vaults. The present invention is capable of maintaining the temperature inside the records storage vault below 150° F. when the ambient temperature outside the records storage vault is up to about 1800° F. The present invention maintains is structural and heat resistive characteristics upon prolonged exposure to temperatures of up to about 1800° F.

The present invention relates to building panels which can be assembled together in a freestanding fashion to define a records storage vault or they can be affixed to the walls of an existing records storage vault or room to provide the insulating capabilities described above. These panels are comprised of one or more layers of insulating material secured within a support frame and a support housing. The side of the insulating material which faces the fire or heat source is known as the outer face. The side of the insulating material which faces the storage volume is known as the inner face.

A support frame is attached to the inner face of the insulating material. A support housing surrounds the outer edges of the insulating material and support frame. The support housing is attached to the outer edges of the support frame. The support housing is made up of straight segments of structural members. These structural members may be embodied in a variety of configurations, such as U-channels, C-studs, and I-beams.

In the preferred embodiments, the insulating material is a high temperature ceramic fiber material. The fiber insulating material may be oriented in several different arrangements or orientations. The layer or layers of fiber insulating material may be laid out flat, placed in a folded edge-grain design, or placed in a combination of the two preceding orientations.

In one preferred embodiment, the support frame is an expanded metal frame, such as a steel mesh frame. An expanded metal frame design is capable of maintaining its structural integrity when exposed to rapid temperature changes, such as those resulting from being sprayed by a fire hose during a fire. The fiber insulating material is secured at its inner face to the support frame by fasteners, such as pins, clips, T-fasteners, and C-fasteners. The support frame and fasteners are preferably made from cold rolled steel, but may be made from any material capable of maintaining its structural integrity under the stress and high temperature conditions for which the support frame and fasteners are intended.

In another preferred embodiment, support frames are secured by fasteners to both the inner and outer faces of the fiber insulating material. The support frame and fasteners secured to the fiber insulating material on the outer face are preferably made from high temperature stainless steel. The fasteners are secured to each support frame in a configuration that compresses the fiber insulating material, resulting in increased insulating performance. This increased insulating performance occurs due to reduced radiative heat transfer through the compressed fiber insulating material.

The panels of the present invention may be assembled together in a freestanding fashion to define a volume that can be used for records storage. In this application, wallboard panels are secured to the outer sides of the support housing on each side of the fiber insulating material. In a preferred embodiment, these panels are a fire-rated plasterboard. In order to reduce heat transfer through the materials, ceramic fiber strips are placed on the outside surfaces of the support housing between the support housing and the wallboard panels. The wallboard panels are secured to the support housing by fasteners or screws. In other embodiments, wallboard is not used and equivalent functional performance is obtained by increasing the thickness of the insulating material.

A ventilation channel is defined by the space between the support frame and the wallboard panel. The width of this channel is equal to the thickness of the support housing and the ceramic fiber material. During exposure to extreme heat, this channel provides a convection path for heat to travel to the top of the panel and exit the panel. As a result of this phenomenon, the volume defined by the assembled panels will be cooled.

The panels of the present invention may also be attached to the walls of an existing vault or records storage area to provide it with enhanced insulating characteristics. The modular panel section is then mounted on the existing wall by securing the support frame on the inner face of the insulating material to the wall with mechanical fasteners, such as pin fasteners. In this embodiment, the wallboard is attached to the support housing at the outer face of the insulating material.

BRIEF DESCRIPTION OF THE DRAWINGS

FIG. 2 is a top cutaway view of the embodiment pictured in FIG. 1.

FIG. 3 is a isometric cutaway view of another embodiment of the invention depicting the interconnection of multiple modular panels.

DETAILED DESCRIPTION OF THE PREFERRED EMBODIMENTS

Figure 1:
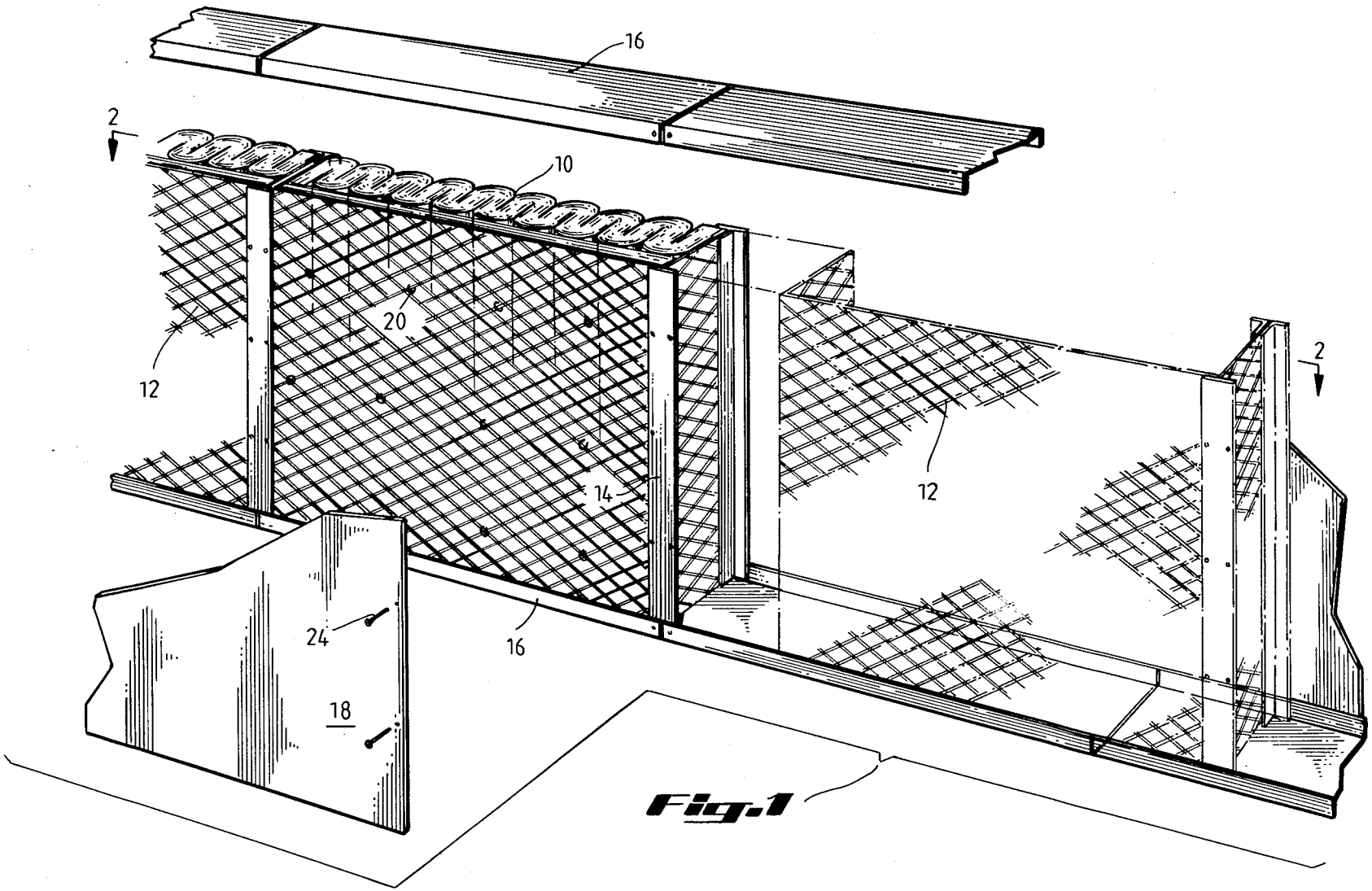
FIG. 1 is an isometric cutaway view of an embodiment of the invention.

Referring to FIG. 1, high temperature ceramic fiber insulating material 10 is laid out flat against expanded metal frame 12. Fiber insulating material 10 in a folded edge-grain design is placed against the flat layer of fiber insulating material 10. Expanded metal frame 12 is attached to support housing side members 14 by fastening methods well known in the art, such as welding. Support housing top and bottom members 16, in the form of a U-channel, fit securely over insulating material 10, expanded metal frame 12, and support housing side members 14. Fasteners 20 secure the fiber insulating material 10 to the expanded metal frame 12. A wallboard panel 18 is secured to the outer side of support housing members 14 and 16 by screws 24.

Referring to FIG. 2, fiber insulating material 10 is secured to expanded metal frame 12 by fasteners 20. Fasteners 20 are depicted in FIG. 2 as loop-type fasteners; however, a number of fastener configurations well known in the art are suitable for this application. Fasteners 20 and expanded metal frame 12 are preferably made from cold rolled steel. A ventilation channel 26 is defined by the space between wallboard panel 18 and expanded metal frame 12.

An alternate embodiment of the invention in which the fiber insulating material 10 is arranged in a flat configuration is depicted in FIG. 3. An expanded metal frame 12 is placed on both the inner and outer face of fiber insulating material 10. Each expanded metal frame 12 is securely attached to support housing side member 14. Fasteners 20 secure fiber insulating material 10 to each expanded metal frame 12. Fastners 20 and expanded metal frame 12 on the outer face of the insulating material 10 are preferably made from high temperature stainless steel.

Figure 4:
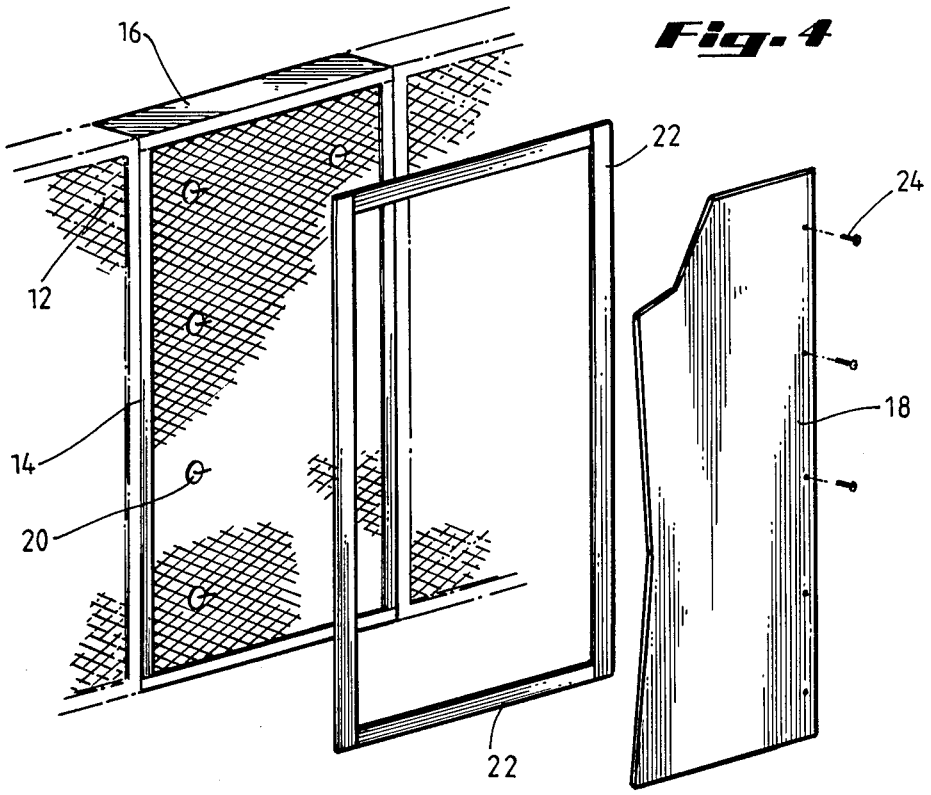
FIG. 4 is a isometric cutaway view of an embodiment of the invention intended to be mounted on an existing wall in modular sections.
Figure 5:
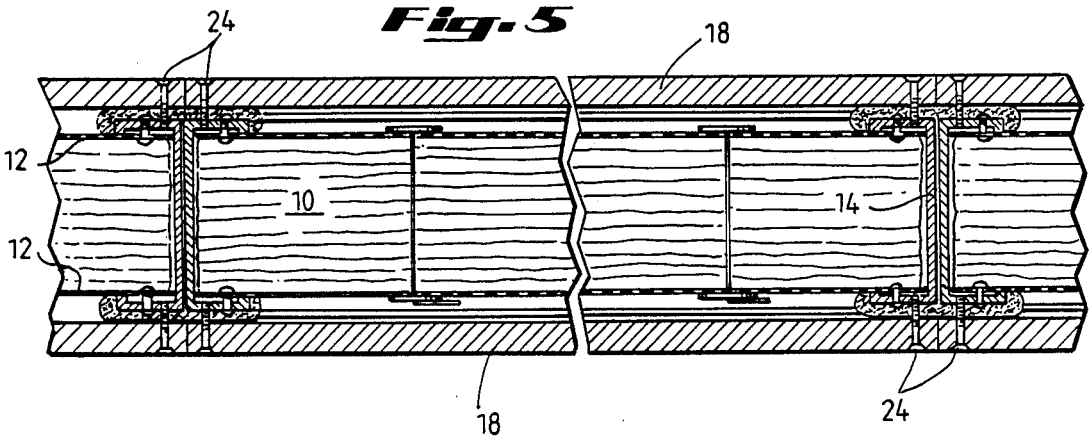
FIG. 5 is a top cutaway view of the embodiment shown in FIG. 3.

An embodiment of the invention intended to be added on to existing walls is shown in FIG. 4. Ceramic fiber strips 22 are placed on all the outer surfaces of support housing members 14 and 16 which are mating surfaces to wallboard panel 18. Wallboard panel 18 is preferably a fire-rated plasterboard. Screws 24 secure wallboard panel 18 to ceramic fiber strips 22 and support housing members 14 and 16. FIG. 5 is a top view of the embodiment shown in FIG. 3. Expanded metal frame 12 is secured to support housing side members 14 by the use of rivets 26.

Many modifications and variations may be made in the embodiments described herein and depicted in the accompanying drawings without departing from the concept of the present invention. Accordingly, it is clearly understood that the embodiments described and illustrated herein are illustrative only and are not intended as a limitation upon the scope of the present invention.

What is claimed is:

1. A fireproof building panel capable of maintaining its structural integrity upon prolonged exposure to temperatures up to about 1800° F. comprising:

panel-shaped high temperature ceramic fiber insulating material having an inner face facing an area to be insulated from heat and an outer face facing toward said temperatures;

a stainless steel expanded metal support frame attached to the outer face of said insulating material;

a cold rolled steel expanded metal support frame attached to the inner face of said insulating material;

a support housing surrounding the outer edges of said insulating material and said frame, said support housing being attached to said frame; and a wallboard panel covering the outer side of said insulating material and secured to said support housing.

2. The building panel of claim 1 wherein the insulating material comprises multiple layers of insulation.

3. The building panel of claim 2 wherein the insulating material comprises multiple layers of insulation and each layer is laid out flat against each adjoining layer.

4. The building panel of claim 2 wherein the insulating material comprises multiple layers of insulation, and the layers are oriented in a folded edge-grain design.

5. The building panel of claim 2 wherein the layer of insulating material adjacent the support frame is flat and the remaining layers of insulating material are oriented in a folded edge-grain design.

6. The building panel of claim 1 wherein the support housing is welded to the outer edge of the support frame.

7. The buidling panel of claim 1 wherein the support housing is a C-type metallic support structure.

8. The building panel of claim 1 wherein the support housing is a U-shaped track made from steel mesh.

9. A fireproof building panel capable of maintaining its structural and heat resistive characteristics upon prolonged exposure to temperatures up to about 1800° F. comprising:

an assembly of side-by-side layers of high temperature ceramic fiber insulating material, the assembly having an inner face and an outer face;

a stainless steel mesh-type support frame attached to the outer face of said assembly;

a mesh-type cold-rolled steel support frame attached to the inner face of said fiber insulating material;

a support housing surrounding the peripheries of said assembly and said support frame, said support housing being attached to said support frame;

a separate fire-resistant wallboard panel secured to each face of said support housing; and ceramic fiber strips secured between said support housing and said wallboard panels.

10. The building panel of claim 9 wherein a ventilation channel is defined by the space between the wallboard panel and the support frame, the width of said channel being equivalent to the thickness of the support housing and the ceramic fiber strips.

11. A building panel for insulating the inner side of the panel from temperatures up to about 1800° F. on the outer side of the panel, comprising:

a panel-shaped assembly of multiple layers of high temperature ceramic fiber insulating material, the assembly having an inner face and an outer face corresponding to said inner and outer sides, respectively;

an open mesh support frame made from cold rolled steel, said support frame attached to the inner face of said assembly;

an open mesh support frame made from stainless steel, said support frame attached to the outer face of said assembly;

a support housing surrounding the peripheries of said assembly and said support frames, said support housing being attached to said support frames;

a separate fire-resistant wallboard panel secured to each face of said support housing and spaced therefrom to define a ventilation channel therebetween; and ceramic fiber strips interposed between said wallboard panels and surfaces of said support housing which mate with said wallboard panels.

12. A fire proof building panel for insulating the inner side of the panel from temperatures up to about 1800° F. on the outer side of the panel, comprising:

panel-shaped, high temperature, ceramic fiber insulating material having inner and outer faces corresponding to the inner and outer sides of the panel, respectively;

a stainless steel expanded metal support frame attached to the outer face of the insulating material;

a steel expanded metal support frame attached to the inner face of the insulating material;

a support housing attached to and surrounding the insulating material and the metal support frames; and a wallboard panel attached to the support housing and spaced from the outer face of the insulating material to define a ventilation channel between the wallboard panel and said outer face.

13. The building panel of claim 12 in which the wall board panel is fire-rated plasterboard.

14. The building panel of claim 13 in which the steel expanded metal support frame is made of cold rolled steel.

* * * * *